US009434892B2

(12) United States Patent
Pradeep et al.

(10) Patent No.: US 9,434,892 B2
(45) Date of Patent: Sep. 6, 2016

(54) TWO STAGE FLUID CATALYTIC CRACKING PROCESS AND APPARATUS

(75) Inventors: Ponoly Ramachandran Pradeep, Faridabad (IN); Sadhullah Mukthiyar, Faridabad (IN); Gadari Saidulu, Faridabad (IN); Debasis Bhattacharyya, Faridabad (IN); Vetterkunnel Kumaran Satheesh, Faridabad (IN)

(73) Assignee: INDIAN OIL CORPORATION LTD., Kolkata (IN)

( * ) Notice: Subject to any disclaimer, the term of this patent is extended or adjusted under 35 U.S.C. 154(b) by 52 days.

(21) Appl. No.: 13/808,835

(22) PCT Filed: Jul. 4, 2011

(86) PCT No.: PCT/IN2011/000445

§ 371 (c)(1),
(2), (4) Date: Mar. 21, 2013

(87) PCT Pub. No.: WO2012/004809

PCT Pub. Date: Jan. 12, 2012

(65) Prior Publication Data

US 2013/0172643 A1 Jul. 4, 2013

(30) Foreign Application Priority Data

Jul. 8, 2010 (IN) ..... 749/KOL/2010

(51) Int. Cl.
*C10G 51/00* (2006.01)
*C10G 51/02* (2006.01)
*C10G 11/18* (2006.01)

(52) U.S. Cl.
CPC ..... *C10G 51/026* (2013.01); *C10G 11/18* (2013.01); *C10G 2300/207* (2013.01);
(Continued)

(58) Field of Classification Search
CPC .... C10G 51/02; C10G 51/026; C10G 51/04; C10G 11/18; C10G 2300/4093; C10G 2300/301; C10G 2300/807; C10G 2300/207; C10G 2400/20; C10G 2400/02
USPC ..... 208/76, 74, 77, 113–124
See application file for complete search history.

(56) References Cited

U.S. PATENT DOCUMENTS 3,748,251 A * 7/1973 Demmel et al. ..... 208/74
3,803,024 A 4/1974 Haunschild
(Continued)

FOREIGN PATENT DOCUMENTS

WO 01/60951 A1 8/2001
WO WO 0160951 A1 * 8/2001

OTHER PUBLICATIONS

Sigmund M. Csicsery. "Catalysis by shape selective zeolites—science and technology" Pure and Applied Chemistry, vol. 58, No. 6, 841-856, 1986.*
(Continued)

*Primary Examiner* — Prem C Singh
*Assistant Examiner* — Brandi M Doyle
(74) *Attorney, Agent, or Firm* — Maschoff Brennan

(57) ABSTRACT

A two stage Fluid Catalytic Cracking process and an apparatus for simultaneous production of light olefins such as ethylene and propylene and middle distillate range hydrocarbons, wherein a first flow reactor, preferably a downer and a second flow reactor, preferably a riser are operating at varying reaction severities using different catalyst systems with the regenerated catalyst entering the reactors inlet through independent regenerators. Mild cracking of the fresh feedstock is carried out in the first flow reactor of short residence time and the effluent of first flow reactor is separated in an intermediate separator/fractionator followed by re-cracking of the C4 hydrocarbons and naphtha range hydrocarbons, preferably C5-150° C. from the second product separation section and unconverted hydrocarbons (370° C.+) of first flow reactor, in the second flow reactor at higher severity employing different catalyst system.

7 Claims, 1 Drawing Sheet

(52) U.S. Cl.
CPC ..... *C10G 2300/301* (2013.01); *C10G 2300/4093* (2013.01); *C10G 2300/807* (2013.01); *C10G 2400/02* (2013.01); *C10G 2400/20* (2013.01)

(56) References Cited

U.S. PATENT DOCUMENTS 3,928,172 A * 12/1975 Davis et al. ..... 208/77
4,436,613 A * 3/1984 Sayles et al. ..... 208/74
4,820,728 A * 4/1989 Collins et al. ..... 514/530
6,093,867 A * 7/2000 Ladwig et al. ..... 585/648
6,106,697 A * 8/2000 Swan et al. ..... 208/77
6,641,715 B1 11/2003 Gauthier
7,220,351 B1 5/2007 Pontier et al.
7,737,317 B1 * 6/2010 Schultz et al. ..... 585/653
2002/0096452 A1 7/2002 Espeillac et al.

OTHER PUBLICATIONS

International Search Report for PCT/IN2011/000445 dated Oct. 11, 2011.

* cited by examiner

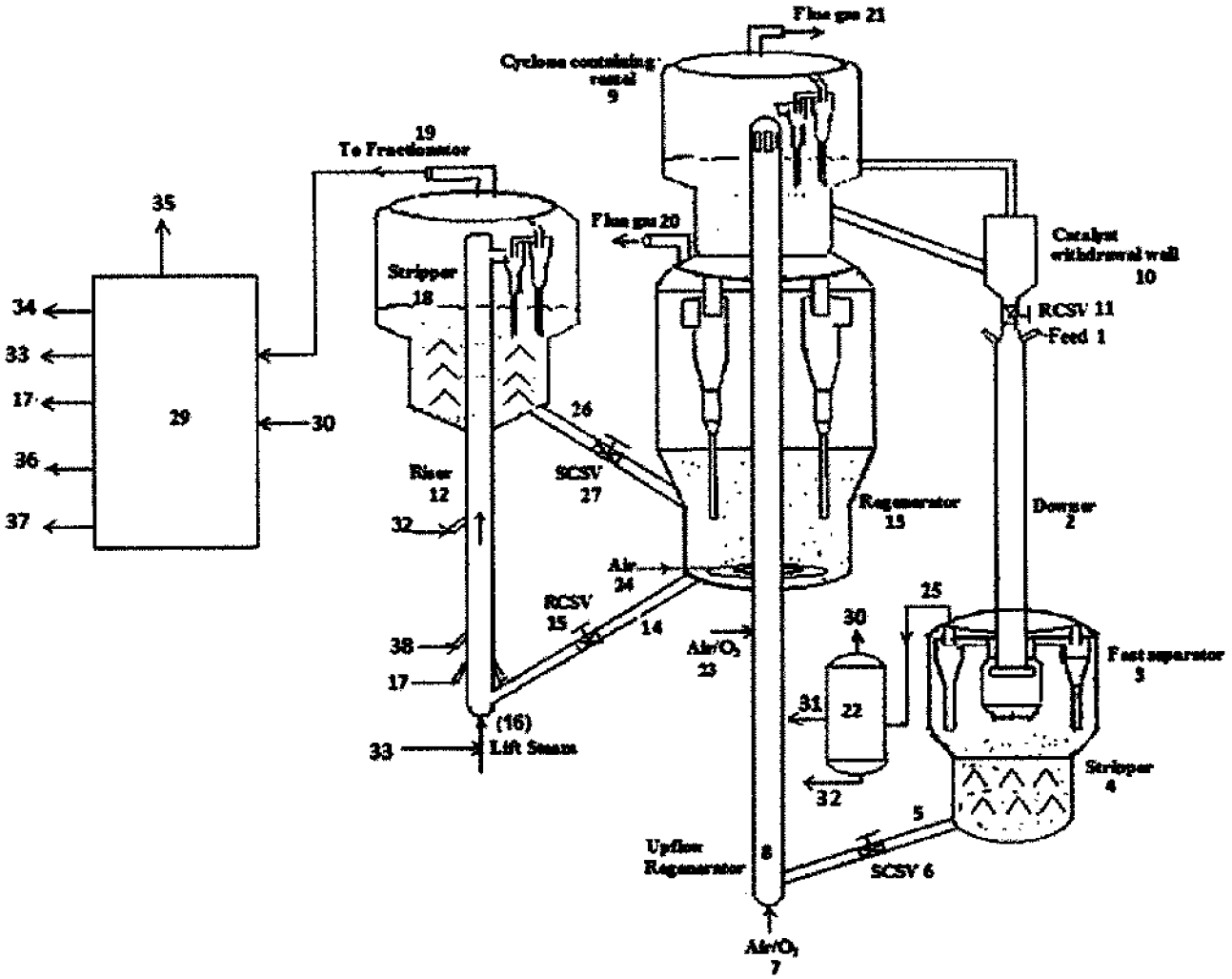
Flue gas 21
Cyclone combustion vessel 9
Catalyst withdrawal well 10
RCSV 11
Feed 1
Flue gas 20
Regenerator 13
Downer 2
Fast separator 3
Stripper 4
25
30
22
31
32
5
SCSV 6
Air/O2 7
8
Air/O2 23
Upflow Regenerator
14
Air 24
26
SCSV 27
RCSV 15
(16) Lift Steam
19
To Fractionator
Stripper 18
Riser 12
32
38
17
33
30
35
29
34
33
17
36
37

TWO STAGE FLUID CATALYTIC CRACKING PROCESS AND APPARATUS

FIELD OF THE INVENTION

This invention relates to Fluid Catalytic Cracking (FCC) of heavy hydrocarbons into lighter fractions with a fluidized stream of solid catalyst. This invention particularly relates to an improved process and apparatus for simultaneous maximization of light olefins including ethylene and propylene and middle distillates, with flexibility of alternate mode of operation for maximization of gasoline.

BACKGROUND OF THE INVENTION

Varying supply-demands for distillate fuels and light olefins like propylene and ethylene, are affecting the oil refiners worldwide. Several drivers, like increasing gap between demand and supply for propylene are affecting the growing need for the production of the same by Fluid Catalytic Cracking. The need for propylene is growing faster than that of ethylene, while on the other hand the co-production of propylene from steam crackers (~70% of supply) is expected to decline as plants are optimized to produce higher-value ethylene. The bulk of the additional propylene will need to be produced from changing the ratios of FCC product streams. Shifts in transportation fuels and changes in fuel's specifications are having a great impact on the refinery. With the increasing growth rates being observed in Asian countries like India and China, demand for middle distillates, which being the major mass transportation fuel is increasing at a higher rate than that for gasoline. Also, in Europe for instance due to the growth of diesel consumption there are several refineries, which are attempting to reduce their gasoline yield because of imbalance over supply. Addition of new technologies in FCC will be needed to further increase the propylene production without compromising the yields of middle distillates.

FCC process involves contacting and cracking a heavier hydrocarbon feed like vacuum gasoil, atmospheric tower bottom, vacuum residue etc. in a reaction chamber with a hot regenerated catalyst in a fluidized condition and removing the products from the deactivated catalyst to yield desired products like LPG, gasoline and middle distillates etc. Catalyst is deactivated due to coke deposition which can be regenerated by burning with air or any oxygen containing gases in the regenerator. With the varying market demands and scarcity of light crudes put immense pressure on refiners to increase the flexibility of the fluid catalytic cracking process to be able to maximize the yield of the desired products. Those who are skilled in the art of FCC can easily understand the design and operational limitations of single stage FCC process. The two-stage processing of hydrocarbon feeds in FCC is used with various objectives, like processing of heavy feeds, maximization of desired products, increasing the quality of the products and scores over the single stage process in every aspect.

U.S. Pat. No. 3,803,024 describes a two stage catalytic cracking configuration, with a common fractionator to increase the product yields. Fresh feed being introduced into a first catalytic cracking zone, employing an amorphous Silica Alumina catalyst and the partially converted material being separated using a fractionator and reintroduced into a second catalytic cracking zone employing a zeolite catalyst to get the desired conversion. Unconverted material from the common fractionator is recycled to any of the two reactors.

The recycle of heavier bottom fractions from the common fractionator results in the buildup of refractory material in the system.

U.S. Pat. No. 5,009,769 describes a parallel two riser system with single reactor stripper with two stage regeneration for converting different types of hydrocarbon feedstocks to light olefins such as propylene. Fractionation of the reactor effluent is carried out in single separation column and naphtha & light cycle oil range hydrocarbons are further cracked in one of the risers. Regenerated catalyst is fed to both risers independently. Here the unit can be tuned to treat a variety of feed qualities.

U.S. Pat. No. 6,287,522B1 describes a process for the dual riser contacting of a primary feed and a secondary recycle feed fraction with independent recovery of the separate streams from the riser cracking zone to improve the product yields and properties. In one of the embodiments, spent catalyst is recycled to one of the risers, to crack fresh feed. The main disadvantage of this process is that the catalyst activity reduces considerably, after passing through one riser and the same catalyst may not be effective in cracking reactions taking place in the second riser.

U.S. Pat. No. 7,491,315B2 describes a dual riser FCC reactor process with light and mixed light/heavy feeds to increase the yield of light olefins. Same catalyst is being circulated in both the riser reactors. The two reactors can be operated under different operating conditions. Coke precursors, which may be a heavy feed, are to be added to the lighter feed to increase the coke make for the proper heat balance of the unit. In all the above mentioned two stage systems employing dual riser reactors, problems like back mixing and higher coke yield persist.

In order to avoid back mixing in the prior art riser, a down flow FCC reactor (hereinafter downer) had been proposed in U.S. Pat. No. 4,385,985. Applications of downer reactor and its applications are given in U.S. Pat. No. 7,153,478 B2. Pilot plant studies conducted by M. A Abul Hamayel (Petroleum Science & Technology, 2004, Vol. 22, No. 5&6, 435-490) show that higher yield of propylene and gasoline obtained from a downer, compared to a riser. Overall coke yield (wt % fresh feed) was also found to be lesser in case of a downer. However, for making use of the advantages of the downer reactor, proper initial contact of the catalyst and feed is very important.

A riser downer coupling reactor has been proposed recently by Fei Liu et al (Ind. Eng. Chem. Res, 2008, Vol. 47, 8582-8587) where, the regenerated catalyst enters at the bottom of the riser reactor and mixes with a fresh hydrocarbon feed and flows upwards and the flow is diverted at the riser top, into a downer reactor to complete the reaction. Changning et al (Chem. Eng. Technol. 2009, Vol. 32, No. 3, 482-491) suggests a downer to riser coupling reactor, where the fresh feed and regenerated catalyst is mixed in the inlet of the downer reactor and flows downward. The downer reactor is connected with a larger diameter riser reactor with a U tube bend, where steam is injected to assist the upflow of the catalyst in the riser reactor.

Chinese Patent No. CN101210191A proposes a similar configuration where the downer and riser reactors are connected in series wherein the hydrocarbon feed is introduced into the inlet of the downer reactor for catalytic cracking at a Catalyst/Oil ratio of 5-40 and operating temperature of 480-660° C., the entire reactor effluent is further contacted in a riser with the spent catalyst from the downer at a Catalyst/Oil ratio of 10-35 and operating temperature of 450-650° C. The disadvantages of such systems are (i) significant reduction in conversion in the second reactor due to use of partially deactivated catalyst from the first reactor; (ii) cracking of the desired product fractions formed in the first reactor. Furthermore, simultaneous maximization of middle distillates and light olefins is not possible using such configuration.

U.S. Pat. Nos. 6,641,715 and 7,220,351B1 describes method and device for catalytic cracking comprising reactors with descending and ascending flows. In U.S. Pat. No. 6,641,715, either recycle or a mixture of fresh feed and recycle feed and regenerated catalyst enters the downer reactor, the cracked gases are separated from the coked catalyst in a first separation zone and the coked catalyst is reintroduced into the lower portion of the riser reactor. The said catalyst and the fresh feed are circulated, the used catalyst is separated from the riser effluent stream, in a second separation zone and it is recycled into regeneration zone consisting of one or two regenerators. A non negligible amount of catalyst will be partially deactivated during the passage through the downer reactor, which reduces the extent of cracking in the riser reactor.

U.S. Pat. No. 7,220,351B1 also describes a similar method, except the use of regenerated catalyst in both reactors. Here the riser is a conventional riser, operating at conventional cracking conditions. The production of olefins and in particular propylene by recycling the gasoline or only a fraction of gasoline produced in the riser to downer.

US Application 2008/0011644A1 describes an ancillary cracking of heavy oils in conjunction with conventional riser FCC unit, using a downer reactor. Here, the production of light hydrocarbons consisting of ethylene, propylene, and butylenes and gasoline is enhanced by introducing heavy oil feed stream derived from an external source into an ancillary down flow reactor that utilizes the same catalyst composition as the FCC unit nearby.

In the above mentioned process scheme, same catalyst is being used in the two reaction zones, namely downer and riser; this makes it less flexible for the processing of feed stocks of widely varying quality.

From the prior art, it can be observed that, researchers have suggested process schemes to maximize the yields and selectivity of desired products like middle distillates, gasoline, propylene etc. Market demand for propylene as well as middle distillates, are increasing worldwide. Therefore, there is a requirement for a process which can simultaneously maximize middle distillates, propylene and ethylene, in order to cater to the increase in demand of both the products.

It is desirable to have an improved FCC process and apparatus for maximization of light olefins including ethylene and propylene and middle distillates, with flexibility of alternate mode of operation for maximization of gasoline.

The present invention relates to a novel process and apparatus of FCC which provides for maximization of light olefins including ethylene and propylene and middle distillates yield, with flexibility of alternate mode of operation for maximization of gasoline.

The invention is aimed at meeting the changed needs of the present demand trend. The invention also discloses suitable apparatus required for the invented process. Refineries must augment their production to be able to be in step with the existing demand of the products. As the present trend shows increasing use of light olefins, their production must be increased economically. The invention additionally offers maximization of gasoline yield. The invention discloses a two stage fluid catalytic cracking process and an apparatus for the same.

SUMMARY OF THE INVENTION

Accordingly, the present invention provides an improved process and apparatus for fluid catalytic cracking wherein catalytic cracking of hydrocarbon feed is done in two flow reactors, a first flow reactor, preferably a downer and a second flow reactor, preferably a riser reactor using separate catalyst systems with intermediate separation of reactor effluents in a first fractionator into three fractions namely, hydrocarbons boiling below 150° C., liquid hydrocarbons with boiling range 150-370° C. and unconverted bottoms (370° C.+). The hydrocarbons boiling below 150° C. are sent to a second product separation section for further separation into products of different desired boiling ranges and liquid hydrocarbons with boiling range 150-370° C. is directly blended with the similar cuts obtained from second product separation section. Second product separation section consists of a main fractionator and a gas concentration section. The first flow reactor is operated at lower reaction temperature than the second flow reactor to maximize the selectivity of middle distillates. Zeolite based catalysts with medium or intermediate pore size of types Y, REY, USY and RE-USY can be used in the first flow reactor. The unconverted bottoms (370° C.+) from the first fractionator along with whole or a part of hydrocarbons in the boiling range of naphtha, preferably C5-150° C. and C4 hydrocarbon molecules from second product separation section are further cracked in second flow reactor at higher reaction temperature to maximize the light olefins such as ethylene and propylene. The catalyst system of second flow reactor contains up to 80% of shape selective pentasil zeolite based catalyst. The effluent from second reactor is separated into fuel gas containing inerts, hydrogen sulphide, hydrogen, methane, ethane and ethylene, C3 hydrocarbons (propane, propylene), C4 hydrocarbons and liquid products such as naphtha, middle distillates and unconverted bottoms (370° C.+) according to the desired boiling ranges, in second product separation section.

DETAILED DESCRIPTION OF THE INVENTION

According to the present invention there is provided a process for two stage fluid catalytic cracking (FCC) of heavy hydrocarbons for simultaneous maximization of middle distillates and light olefins such as ethylene and propylene with flexibility of alternate mode of operation for maximization of gasoline, by carrying out the cracking operation in two separate flow reactors operating under varying severities using different catalyst systems with simultaneous regenerations of respective catalysts comprising the following steps:

a) contacting fresh feedstock with regenerated catalyst from first regenerator, under fluidized condition in presence of steam in a first flow reactor preferably a downer for cracking the hydrocarbons to produce a mixture of spent catalyst and reactor effluent vapors,
b) separating the spent catalyst from the reactor effluent vapors of step (a) quickly using a fast gas solid separator; the separated spent catalyst being subjected to multistage steam stripping to remove the entrained hydrocarbon vapors followed by regenerating the catalyst in an up flow regenerator, using air/oxygen containing gas to obtain a regenerated catalyst with carbon content below 0.1 wt % suitable for the cracking operation again in the first flow reactor,
c) separating the said first reactor effluent vapors of step (a) using a first fractionator into three fractions namely, hydrocarbons boiling below 150° C., liquid hydrocarbons preferably with boiling range 150-370° C. and unconverted bottoms (370° C.+). The hydrocarbons boiling below 150° C. are sent to a second product separation section for further separation into products of different desired boiling ranges. Liquid hydrocarbons with boiling range 150-370° C. are directly blended with the similar cuts obtained from second product separation section, d) contacting the unconverted bottoms (370° C.+) from first fractionator, along with whole or a part of hydrocarbons in the boiling range of naphtha and C4 hydrocarbons from the second product separation section along with/without fresh feed, with regenerated catalyst from the second regenerator; comprising up to 80 wt % of shape selective pentasil zeolite based catalyst, in the second flow reactor preferably a riser, at higher temperature and higher contact time than the first flow reactor under fluidized condition in presence of steam to produce a mixture of spent catalyst with cracked hydrocarbon vapors, e) separating the spent catalyst from the hydrocarbon vapors of step (d) quickly using a separation device and steam stripping with a counter current steam flow followed by regeneration of the spent catalyst in a second regenerator with air or oxygen containing gases to obtain a regenerated catalyst with carbon content below 0.1 wt % suitable for the cracking operation again in the said second flow reactor, and f) fractionating the hydrocarbon effluent from the second flow reactor into fuel gas containing inerts, hydrogen sulphide, hydrogen, methane, ethane and ethylene, C3 hydrocarbons (propane, propylene), C4 hydrocarbons and liquid products such as naphtha, middle distillates and unconverted bottoms (370° C.+) according to the desired boiling ranges, in the second product separation section.

The catalyst used in the first flow reactor is selected from the types of Y, REY, USY and RE-USY zeolites with medium or intermediate pore size of 7-11 Angstroms and whereas the catalyst used for the second flow reactor comprise of large pore bottom selective active material of pore size more than 50 Angstroms and shape selective pentasil zeolite based catalysts of pore size 5-6 Angstroms. The residence time of hydrocarbons in the first flow reactor and the second flow reactor are kept in the range of 0.5-2 seconds and 1-4 seconds, respectively. Cracking in the first flow reactor is allowed to take place at a temperature of 470-550° C. at a catalyst/oil ratio of 4-15 and in the second flow reactor at a temperature of 550-650° C. at a catalyst/oil ratio of 10-25.

Regenerated catalysts are supplied at the inlet of the respective flow reactors through separate conduits for achieving the reactor outlet temperatures. The steam flow in the first flow reactor is varied depending on the feedstock quality and desired velocity in the downer.

According to this invention, there is also provided an apparatus for two stage fluid catalytic cracking (FCC) of feed hydrocarbons for simultaneous maximization of light olefins such as ethylene and propylene and middle distillates with flexibility of alternate mode of operation for maximization of gasoline, with separate regenerators for regenerating different spent catalysts used therein comprising the following units:

i) a first flow reactor having means for injecting hydrocarbon feed and another means for entry of regenerated catalyst at one end of the reactor, a gas solid separator-stripper at the other end of the reactor, ii) a gas solid separator with stripper connected to the first flow reactor of said unit (i) having a multistage steam stripping means, to separate the hydrocarbon product vapors entrapped in spent catalyst obtained from the first flow reactor and an outlet for exit of the hydrocarbon vapors from the separator-stripper, iii) another gas solid separator, preferably cyclone separator connected to the outlet of the separator-stripper to remove the entrained catalyst particles from the reactor stripper effluent and connected to first fractionator by suitable means, for separating the hydrocarbon vapors effluent exiting therefrom into three product streams comprising, hydrocarbons boiling below 150° C., liquid hydrocarbons with boiling range preferably 150-370° C. and unconverted bottoms (370° C.+); having means for transporting the hydrocarbons boiling below 150° C. to second product separation section and unconverted bottoms and optionally the hydrocarbons with boiling range 150-370° C. as a feedstock to second flow reactor.

iv) a second flow reactor having a means for entry of feed hydrocarbons comprising, unconverted bottoms from fractionator of said unit (iii), naphtha and C4 hydrocarbons from second product separation section mentioned therein, along with/without fresh feed and another means for entry of regenerated catalyst at one end of the reactor and at the other end connected to a separation device preferably cyclone separator. The second flow reactor has a first inlet for entry of C4 hydrocarbons/steam from second product separation section of said unit (iii) and a second inlet for entry of regenerated catalyst from the catalyst regenerator of the second stage, and a third inlet for naphtha range hydrocarbons from the second product separation section and a fourth inlet for entry of fresh feed and a fifth inlet for entry of unconverted hydrocarbons from first fractionator, and at the other end connected to a separation device with stripper for separating the spent catalyst and the cracked vapors therefrom, v) a separation device of said unit (iv), accommodated in a vessel connected to a stripper having a multistage steam stripping means, for separating the cracked hydrocarbon vapors entrapped in spent catalyst coming out of the second flow reactor and with means for taking out the cracked hydrocarbon vapors to the second product separation section for separating out the desired hydrocarbon products, vi) a second product separation section for fractionating the cracked hydrocarbon products of the second flow reactor of the said unit (v) and hydrocarbons fraction with boiling range up to 370° C. coming from the first fractionator, into various hydrocarbon products according to desired ranges of boiling points, vii) an upflow regenerator for regeneration of spent catalyst from the first flow reactor, having an inlet near the bottom which is connected to the bottom of the separator stripper of said unit (ii) for entry of the spent catalyst thereof with inlets at the bottom and at other elevations for entry of air/oxygen containing gas therein, and connected at the top with a cyclone containing vessel with closed couple cyclone separator system to remove the entrained regenerated catalyst particles from the flue gas and to collect the regenerated catalyst at the bottom of the vessel, and an outlet for exit of the flue gas therefrom, and viii) a dense or fast fluidized bed catalyst regenerator, for regenerating the spent catalyst collected from the separation device with stripper of unit (v).

ix) a part of the upflow regenerator of unit (vii), placed inside the dense or fast fluidized bed regenerator of unit (viii)

According to the invented process, fresh feed is contacted with the regenerated catalyst supplied from the dense bed of the cyclone containing vessel, at the end of the upflow regenerator, in the first flow reactor of short contact time in the range of 0.5-2 seconds, preferably a downer reactor, to undergo cracking reaction. The Regenerated catalyst is supplied to the downer reactor by a downwardly directed conduit or pipe, called regenerated catalyst stand pipe with a slide valve.

The slide valve opening is controlled in a conventional manner by a control loop, comprising a temperature sensing means, such as a thermocouple, in the exit portion of the reactor vessel and a controller, with a temperature set point. The regenerated catalyst stand pipe is equipped at its exit end with a means, facilitating efficient and uniform distribution of the catalyst throughout the cross sectional area of the downer reactor.

The hydrocarbon feed is introduced at suitable elevation below the catalyst entry point in the downer, using a multi feed nozzle set up. Steam is passed through the nozzle to atomize the liquid feed into small droplets. Ultra short residence times of the order of 0.5 seconds, is possible in the downer reactor, which coupled with uniform radial distribution of the catalyst and nearly plug flow condition, results in lower coke yield.

The catalyst and hydrocarbon feed mixture flows in the downward direction to the end of the downer reactor. Cracking of hydrocarbon feed happens during the course of this flow and coke is deposited on the catalyst, which deactivates the catalyst temporarily. At the end of the downer reactor, the hydrocarbon vapors are separated quickly from the coked or spent catalyst by a separation device. The hydrocarbons entrained in the pores of the catalyst are stripped of using steam stripping in a counter current multistage steam stripper. The spent catalyst is then withdrawn from the stripper using a spent catalyst stand pipe, with a slide valve.

The spent catalyst is then sent to the upflow regenerator operating in fast fluidization/transport regime, and is distributed uniformly using a catalyst distributor at the bottom. Air or oxygen containing gases are given to the bottom of the upflow regenerator, for regeneration. An excess air of at least 0.5% is supplied in order to facilitate the complete combustion of the coke deposited on the catalyst. The upflow regenerator operates at a temperature of 600-750° C. with a catalyst residence time in the range of 5-50 seconds. Air or oxygen containing gases may be supplied at different elevations, as required for the complete regeneration of the spent catalyst.

A part of the upflow regenerator is positioned inside the dense bed/fast fluidized bed regenerator vessel, which helps to reduce the heat losses from the upflow regenerator and to reduce the temperature of catalyst mixture in dense bed regenerator. This also helps to increase the heat content of the regenerated catalyst to be supplied to the downer reactor, in cases where coke yield in downer reactor is significantly lower than that compared to the riser reactor, improving the unit heat balance. The upflow regenerator is provided with a termination device as shown in the FIG. 1 but not limited to, and maybe selected from the various configurations available in the FCC art, and terminates in a cyclone containing vessel having cyclones comprising of single, multiple, multiple in parallel or series, series and parallel, positioned internal or external or as a combination thereof, to the vessel. Regenerated catalyst moves up and is fed into the dense bed of a cyclone containing vessel. The flue gas along with the catalyst fines generated due to attrition of the catalyst particles, along with entrained particles enters the cyclone separators at the top, where, the flue gas is sent out of the regenerator, separated from the catalyst particles.

The hydrocarbon vapors exiting from the stripper of the downer reactor is sent to a first fractionator, to separate the same into three fractions namely, hydrocarbons boiling below 150° C., liquid hydrocarbons with boiling range 150-370° C. and unconverted bottoms (370° C.+). The hydrocarbons boiling below 150° C. are sent to a second product separation section for further separation into products of different desired boiling ranges and liquid hydrocarbons with boiling range 150-370° C. is directly blended with the similar cuts obtained from second product separation section. Unconverted bottoms (370° C.+) from first fractionator, along with whole or a part of hydrocarbons in the boiling range of naphtha and C4 hydrocarbons from the second product separation section along with/without fresh feed is then contacted with regenerated catalyst in a riser reactor, providing a hydrocarbon residence time 1-4 seconds and operating at a temperature in the range of 550-650° C. with a Cat/Oil ratio of 10-25. The regenerated catalyst from the dense bed/fast fluidized bed regenerator vessel is withdrawn using a downwardly directed conduit or pipe, called regenerated catalyst stand pipe, equipped with a slide valve. The slide valve opening is controlled in a conventional manner by a control loop, comprising a temperature sensing means, such as a thermocouple, placed near the exit of the riser reactor and a controller, with a temperature set point. The regenerated catalyst stand pipe is equipped at its exit end with a means, facilitating efficient and uniform distribution of the catalyst throughout the cross sectional area of the riser.

The catalyst and hydrocarbon feed mixture flows in the upward direction to the end of the riser reactor. Cracking of hydrocarbon feed happens during the course of this flow and coke is deposited on the catalyst, which deactivates the catalyst temporarily. At the end of the riser reactor, the hydrocarbon vapors are separated quickly from the coked or spent catalyst by a separation device. The hydrocarbons entrained in the pores of the catalysts are stripped of using steam stripping in a counter current multistage steam stripper.

The spent catalyst is then withdrawn from the stripper using a spent catalyst stand pipe equipped with a spent catalyst slide valve. The spent catalyst is then sent to the dense bed/fast fluidized bed regenerator for burning of the coke. The said regenerator may be operated with a catalyst residence time of 2-10 minutes. Air is sent to the regenerator using an air grid, designed to supply the air uniformly throughout the dense bed of the regenerator. A certain amount of excess air of at least 0.5% is supplied in order to facilitate the complete combustion of the coke deposited on the catalyst. CO combustion promoters can be added to the catalyst to facilitate effective and complete combustion of carbon monoxide in the dense bed of the regenerator, in order to avoid any after burning in the regenerator dilute phase. The flue gas generated along with the catalyst fines generated due to attrition of the catalyst particles enters the cyclone separators at the top, where, the flue gas is sent out of the regenerator, separated from the catalyst particles.

Hydrocarbon feedstock which can be processed in the apparatus provided, includes a wide range of hydrocarbon fractions starting from carbon number 4, naphtha, gas oil, vacuum gas oil, atmospheric tower bottom, vacuum tower bottom, refinery slope oil mixtures thereof. The hydrocarbon fractions could be straight run or cracked components produced by catalytic processes, as for example, FCC, hydrocracking, hydrotreating or thermal cracking processes like coking, visbreaking etc. Feedstocks of external origin like, natural gas condensate liquids, bio oil etc. can be also used. Heavy residual feedstocks with up to 11 wt % conradson carbon content and having nickel and vanadium content of more than 50 ppm can be processed, by the selection of suitable metal passivators/traps in the first stage. However, the process conditions in the process of the present invention are adjusted so as to maximize the yield of desired products like middle distillates and light olefins such as ethylene and propylene.

Catalyst employed in the first reactor of the invented process can be selected from the types Y, REY, USY and RE-USY with intermediate pore size, for use in the first flow reactor whereas, the catalyst system employed in the second flow reactor consists of up to 80 wt % shape selective pentasil zeolite based catalyst. CO combustion promoters can be added to both catalyst systems in order to prevent after burning in the regenerator dilute phase. Metal passivation technology and or metal trap additives can be used to nullify the deleterious effects of nickel, vanadium etc.

DESCRIPTION OF THE INVENTION WITH REFERENCE TO THE ACCOMPANYING DRAWING

The two stage FCC apparatus described in the invention, as shown in FIG. 1 consists of one downer reactor (2) and a riser reactor (12). Fresh feed is injected through a feed nozzle assembly (1) at the top of the downer reactor just below the regenerated catalyst entry zone. Steam is used to atomize the liquid feed in the nozzle. The steam flow can be varied depending on the feed stock quality and desired velocity in the downer (2). The regenerated catalyst enters the downer reactor through a regenerated catalyst standpipe. The flow of regenerated catalyst is controlled by the regenerated catalyst slide valve (11). The feed and catalyst contact and the mixture flows down the downer reactor (2). At the end of the downer, the spent catalyst is separated quickly, from the hydrocarbon product vapors using a fast gas solid separator (3). The separated catalyst is subjected to multistage steam stripping to remove the entrained hydrocarbon vapors in the stripper (4). A stand pipe (5) attached to the stripper bottom carries the spent catalyst from the stripper to the bottom of the upflow catalyst regenerator (8). The flow of spent catalyst is controlled by the spent catalyst slide valve (6). The spent catalyst is carried up the upflow regenerator (8) using the air/oxygen containing gases supplied at the bottom (7). The spent catalyst moves up through the upflow regenerator (8) and regeneration takes place, by burning off the coke deposited on the catalyst. The flue gas with entrained fine catalyst particles, which are generated due to attrition phenomena, enters the closed coupled cyclone separator system in the cyclone containing vessel (9) to remove the entrained catalyst particles from the flue gas (21). The hydrocarbon vapors exiting (25) from the stripper-separator (3 and 4) is sent to a first separator/fractionator (22), to separate the same into three product streams comprising, hydrocarbons boiling below 150° C. (30), liquid hydrocarbons with boiling range preferably 150-370° C. (31) and unconverted bottoms boiling above 370° C. (32). The hydrocarbons boiling below 150° C. (30) and liquid hydrocarbons with boiling range 150-370° C. (31) are directly blended with the similar cuts obtained from second product separation section (29). The whole or a part of C4 hydrocarbons (33) and naphtha (17) separated from the rest of the products in the second product separation unit (29), and unconverted bottoms (32) from the first fractionator (22), along with or without fresh feed (38) is then sent to the riser (12) reactor. It might be duly noted that, the feed entry arrangements for different hydrocarbons to the riser reactor may consist of different single/multiple nozzles positioned at different locations/elevations or any other suitable fashion. A lift gas, which may preferably be, steam (16) is given at the bottom of the riser reactor (12), in order to assist the upward flow of catalyst and uniform radial distribution of the catalyst in the riser (12). Regenerated catalyst from the dense or fast fluidized bed regenerator vessel (13) enters the bottom of the riser reactor (12) through the regenerated catalyst stand pipe (14). The flow of the regenerated catalyst to the bottom of the riser reactor is controlled by the regenerated catalyst slide valve (15). The feed mixes with the catalyst from the regenerator (13) and moves upward, to undergo the cracking reaction in the riser reactor (12). At the end of the riser, the spent catalyst is removed quickly, from the hydrocarbon vapors using a separation device, like a closed coupled cyclone system. The separated catalyst is then stripped with a counter current steam flow in the stripper (18). The separated product hydrocarbons (19) are then sent to the second product separation section (29) to separate the desired products according to their boiling ranges such as fuel gas (35), C3 hydrocarbons (34), C4 hydrocarbons (33), naphtha (17), middle distillates (36) and unconverted hydrocarbons boiling above 370° C. (37). The spent catalyst from stripper (18) is then sent to a regenerator vessel (13) via a spent catalyst stand pipe (26). A spent catalyst slide valve (27) is used to regulate the flow of spent catalyst from the stripper (18) to the regenerator (13). The flue gas (20) separated from the catalyst fines exits the regenerator from the top. In the FIG. 1 provided for illustration purpose, the cyclone separator systems in cyclone containing vessel (9), gas solid separators and regenerator may comprise of single, multiple, multiple in parallel or series, cyclones in series and parallel, positioned internal or external or a combination thereof, to the vessel.

The invention is now exemplified by way of a few examples which are some of the specific embodiments of the present invention. These are not to limit the scope of the invention which is defined in the following statement of claims.

Example 1

The invented process can be used for the maximization of propylene alone, using a process scheme described as under. Fresh feed is contacted at the entry of the first flow reactor of short contact time with hot circulating catalyst coming from the regenerator, where the cracking reactions take place providing a contact time in the range of 0.2-0.5 seconds. The reaction temperature is around 550-650° C. with catalyst to hydrocarbon feed ratio in the range of 10-35. The first reactor effluent fraction, boiling above 150° C. which are separated using first fractionator and hydrocarbon fractions, naphtha and C4 from second product separation section are passed through the second flow reactor, operating at a temperature of 550-650° C. with a hydrocarbon residence time below 3 sec and catalyst to oil ratio of 10-25. A highly active Y zeolite catalyst containing 5-30 wt % of shape selective pentasil zeolite based catalyst can be used in the first flow reactor, and a highly active Y zeolite catalyst containing 5-50 wt % of shape selective pentasil zeolite based catalyst and 2-10 wt % of large pore bottom upgrading components can be used in the second flow reactor.

Example 2

The invented process can be used for the maximization of gasoline alone, using a process scheme described as under. Fresh feed is contacted at the entry of the first flow reactor of short contact time with hot circulating catalyst coming from the regenerator, where the cracking reactions take place providing a contact time in the range of 0.5-1 seconds. The reaction temperature is around 500-580° C. with catalyst to hydrocarbon feed ratio in the range of 515. The first reactor effluent fraction, boiling above 210° C., are separated using a first fractionator, are then passed through the second flow reactor, operating at a temperature of 500-560° C., with a hydrocarbon residence time of 1-3 sec and catalyst to oil ratio of 5-12. REUSY/USY-Zeolite based catalysts with 2-10 wt % of shape selective pentasil zeolite based catalyst can be used in both the flow reactors.

Example 3

The invented process can be used for the maximization of middle distillates alone, using a process scheme described as following. Fresh feed is contacted at the entry of the first flow reactor of short contact time with hot circulating catalyst coming from the regenerator where the cracking reactions take place providing a contact time below 2 seconds. The reaction Temperature is around 450-520° C. with catalyst to hydrocarbon feed ratio in the range of 4-8. The first reactor effluent fraction boiling above 370° C. are separated using a first fractionator are then passed though the second flow reactor, operating at a temperature of 470-530° C., with a hydrocarbon residence time below 5 sec and catalyst to oil ratio of 4-10. A catalyst with high matrix content can be used in the first flow reactor and low active catalyst containing 5-30 wt % of large pore bottom selective active material, can be used in the second flow reactor.

In one embodiment, a part of the unconverted bottom fractions from the second fractionator is recycled to the downer reactor, mixed with the fresh feed in order to increase the conversion. A part of the recycle is to be purged to prevent the buildup of coke precursors in the system.

In another embodiment, a part of fresh feed is injected into the riser reactor to increase conversion.

In yet another embodiment, the entire product materials coming from the downer reactor can be fed into the short riser reactor directly, thereby eliminating the use of first fractionator/separator after the downer reactor.

The invention claimed is:

1. A process for two stage fluid catalytic cracking (FCC) of hydrocarbon feedstocks boiling above 200° C. for simultaneous maximization of light olefins and middle distillate range hydrocarbons with flexibility of alternate mode of operation for the maximization of gasoline by carrying out the cracking operation in two separate flow reactors operating under varying severities using different and independent catalyst systems with simultaneous regeneration of respective catalysts comprising the following steps:

(a) contacting fresh hydrocarbon feedstock with regenerated catalyst of first type at a catalyst/oil ratio of 4-15; wherein the catalyst of the first type is an intermediate pore size zeolite catalyst selected from the types Y, REY, USY and RE-USY under fluidized condition in presence of steam in a first flow reactor for cracking of the hydrocarbon at a lower temperature and for a short contact period, wherein a residence time of hydrocarbon is kept between 0.5-2 seconds, to produce a mixture of spent catalyst and reactor effluent vapors, (b) separating the spent catalyst of first type from the reactor effluent vapors of step (a) quickly using a fast gas solid separator, the separated spent catalyst of the first type being subjected to multistage steam stripping to remove the entrapped hydrocarbon vapors followed by regenerating the spent catalyst of the first type in an up flow catalyst regenerator using air/oxygen containing gas to obtain a regenerated catalyst of first type with carbon content below 0.1 wt % suitable for the cracking operation again in the first flow reactor, (c) separating the first reactor effluent vapors of step (a) using a first separator/fractionator into three fractions which are hydrocarbons boiling below 150° C., liquid hydrocarbons with boiling range 150-370° C. and unconverted bottoms (370° C.+) and sending the hydrocarbons boiling below 150° C. to a second product separation section for further separation into products of different desired boiling ranges and liquid hydrocarbons with boiling range 150-370° C. is directly blended with similar cuts obtained from the second product separation section, (d) contacting the unconverted bottoms (370° C.+) from first fractionator, whole or a part of hydrocarbons in the boiling range of naphtha and C4 hydrocarbons from the second product separation section with regenerated catalyst of second type, wherein the catalyst of the second type consists of a mixture of large pore bottom selective active material of pore size more than 50 Angstroms and shape selective pentasil zeolite based catalyst in a second flow reactor at a catalyst/oil ratio of 13-25, at higher severity than the first flow reactor at a higher temperature and higher contact period under fluidized condition in presence of steam to produce a mixture of spent catalyst of second type with reactor effluent vapors, (e) separating the spent catalyst of second type from the reactor effluent vapors of step (d) quickly using a fast gas solid separation device, and steam stripping with a counter current steam flow followed by regeneration of the spent catalyst of second type in a dense bed/fast fluidized bed regenerator with air/oxygen containing gases to obtain the regenerated catalyst of second type with carbon content below 0.1 wt % suitable for the cracking operation again in the said second flow reactor, and (f) separating the reactor effluent vapors from the second stage flow reactor into fuel gas containing inerts, hydrogen sulphide, hydrogen, methane and ethane, ethylene, C3 hydrocarbons (propane, propylene), C4 hydrocarbons and liquid products according to the desired boiling ranges, in the second product separation section.

2. A process as claimed in claim 1, wherein the contact period of hydrocarbons is kept between 1-4 seconds in the second flow reactor.

3. A process as claimed in claim 1, wherein a part of the fresh hydrocarbon feedstock is optionally injected into the second reactor.

4. A process as claimed in claim 1, wherein the catalyst of the second type consists of up to 80 wt % shape selective pentasil zeolite based catalyst and remaining large pore bottom selective active material of pore size more than 50 Angstroms.

5. A process as claimed in claim 1, wherein the cracking in the first flow reactor is allowed to take place at a temperature of 470-550° C. and in the second flow reactor at a temperature of 550-650° C., depending upon the type of feed.

6. A process as claimed in claim 1, wherein regenerated catalysts are supplied at the beginning of the respective flow reactors through separate conduits.

7. A process as claimed in claim 1, wherein steam flow in the first flow reactor is varied depending on the feed stock quality and desired velocity in the first flow reactor.

* * * * *